United States Patent [19]

Charzewski

[11] Patent Number: 4,942,756

[45] Date of Patent: Jul. 24, 1990

[54] MULTI-JAW FORMING PRESS ESPECIALLY SUITED FOR DETAILS OF VARIABLE SECTIONS

[76] Inventor: Jan Charzewski, ul. Batuty 7/619, 02-743 Warszawa, Poland

[21] Appl. No.: 158,080

[22] Filed: Feb. 12, 1988

Related U.S. Application Data

[63] Continuation-in-part of Ser. No. 748,553, Jun. 25, 1985, abandoned.

[30] Foreign Application Priority Data

Jul. 18, 1984 [PL] Poland ..... 248802

[51] Int. Cl.[5] ..... B21D 41/04

[52] U.S. Cl. ..... 72/399; 72/402; 72/468

[58] Field of Search ..... 72/399, 402, 393, 468

[56] References Cited

U.S. PATENT DOCUMENTS

| | | | |
|---|---|---|---|
| 2,842,839 | 7/1958 | Benjamin et al. | 72/393 |
| 3,382,699 | 5/1968 | Seeman | 72/393 |
| 3,695,087 | 10/1972 | Tuberman | 72/402 |
| 4,084,526 | 4/1978 | Spisak | 72/393 |
| 4,308,744 | 1/1982 | Baker | 72/402 |
| 4,454,657 | 6/1984 | Yasumi | 72/402 |

FOREIGN PATENT DOCUMENTS

| | | | |
|---|---|---|---|
| 0667403 | 11/1938 | Fed. Rep. of Germany | 72/468 |
| 1953123 | 4/1971 | Fed. Rep. of Germany | 72/402 |
| 2004532 | 8/1971 | Fed. Rep. of Germany | 72/399 |
| 1940854 | 10/1971 | Fed. Rep. of Germany | 72/402 |
| 1954575 | 9/1972 | Fed. Rep. of Germany . | |
| 1453427 | 9/1966 | France | 72/468 |
| 59556 | 5/1981 | Japan | 72/393 |
| 0505090 | 5/1939 | United Kingdom | 72/468 |
| 1293059 | 10/1972 | United Kingdom . | |

*Primary Examiner*—David Jones
*Attorney, Agent, or Firm*—Ladas & Parry

[57] ABSTRACT

The invention solves the problem of working the details of complicated forms and of direct extrusion of material. A press is provided with movable, profiled jaws, a rigid system of guides for the jaws, and, connectors embedded in the jaws and coupled to a driver. The driver is aligned on the connectors which drive the jaws. The press can also include a mould being adjoined to the jaws.

3 Claims, 2 Drawing Sheets

MULTI-JAW FORMING PRESS ESPECIALLY SUITED FOR DETAILS OF VARIABLE SECTIONS

This is a continuation-in-part of co-pending application Ser. No. 748,553 filed on June 25, 1985, now abandoned.

An object of the invention is a device to form materials, especially plastic materials. Advantageously this device is applicable to mass production.

BACKGROUND OF THE INVENTION

Known from the GFR patent description No. 1954575 is a forming press with a minimum of three starlike arranged prismatic clamping jaws, for forming tubes. The front surfaces of the clamping jaws are directed between flat inner surfaces of a press frame and they move simultaneously to a central point of a profile orifice which is formed by the clamping jaws. The surface of the clamping jaw, which lies parallel to the axis of the profile orifice, moves on the surface of an adjoining clamping jaw, reducing the profile orifice. Identical clamping jaws, fixed inside the frame, copy with their surfaces a profile orifice corresponding with the frame's inner profile. On the frame each inner flat surface clamping jaw slides on one surface. This surface of the clamping jaw adjoins with a surface limiting profile orifice, and it lies opposite the surface, and borders an adjoining clamping jaw. In the known forming press one hydraulic drive is applied, it acts on this surface of a prismatic clamping jaw, which lies opposite the surface of clamping jaw, reducing the profile orifice.

In known forming press identically shaped prismatic clamping jaws copy the profile orifice, to form a regular figure, e.g. corresponding with the press frame inside profile. One clamping jaw drive is used, directed on the jaw surface parallel to profile orifice axis, this is an inefficient solution.

SUMMARY OF THE INVENTION

The device according to this present invention comprises movable jaws arranged around the axis thereof and lying at a common plane, perpendicular to the said axis, while each of the said jaws is provided with a guiding surface, with a profiled working surface opposite thereto, copying the final fragment of the object being formed, and two lateral surfaces. Each of the said lateral surfaces allows the movement along the lateral surface of the adjoining jaw and each of the surfaces is generated of parallel generating lines coming through the line which is the border of contact of the said adjoining profiled working surfaces. The said device further comprises a rigid system for guiding each of the said jaws along their guiding surfaces; connectors fitted in the said jaws and a driver being aligned therein, driving the said jaws through above connectors. The press comprises also a mould being adjoined to the said jaws.

BRIEF DESCRIPTION OF THE DRAWINGS

The object of the invention is shown in examples of execution on drawings, on which

DESCRIPTION OF THE PREFERRED EMBODIMENTS

Figure 1:
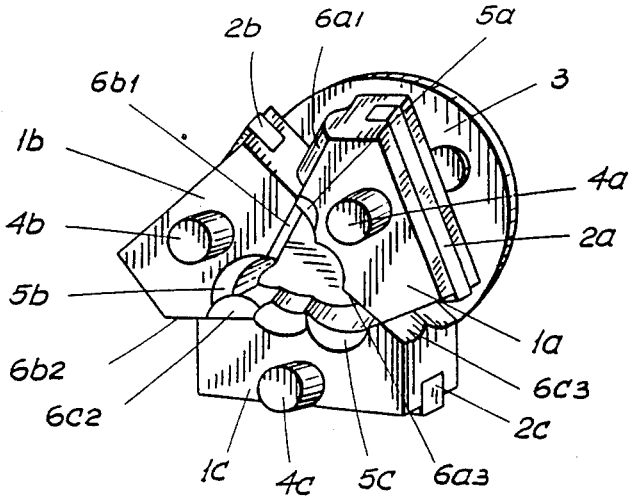
FIG. 1 presents in perspective view the press with displaced jaws, working surfaces of which are directed to the inside, FIG. 2 —the same device with pushed together jaws, FIG. 3 —the device with jaws directed outside in longitudinal section, FIG. 4 —the same device in cross-section, FIG. 5A —an alternative of the device presented in FIG. 3 and FIG. 4 in cross-section.
Figure 2:
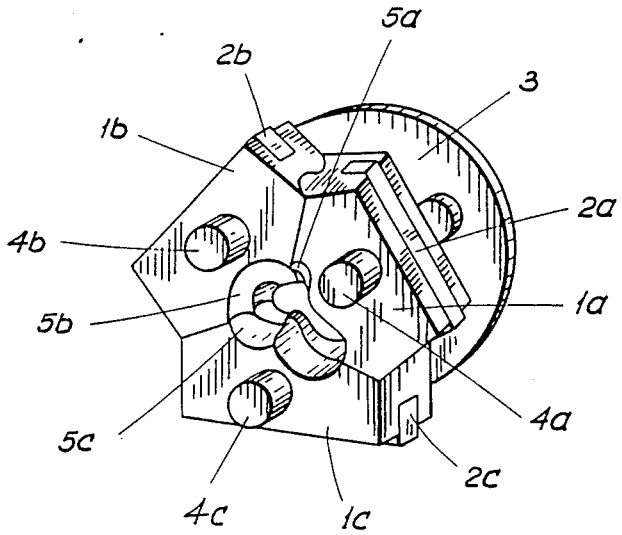

The device, according to the invention, presented in FIG. 1 and FIG. 2 is composed of three jaws 1*a*, 1*b*, 1*c* movably mounted on guides 2*a*, 2*b*, 2*c* and a driver 3 driving jaws 1*a*, 1*b*, 1*c* through connectors 4*a*, 4*b*, 4*c*. The said guides constitute a frame which is not illustrated. The driver 3 is a flat element adjacent to the jaws 1*a*, 1*b* and 1*c*. In the drawing, the driver 3 was shown only from one side, i.e. from the side of jaws 1*a*, 1*b* and 1*c*. Driver 3 is provided with a central orifice for feeding the material and with elongated orifices disposed radially to the axis of the device. Into the said elongated orifices the connectors 4*a*, 4*b* and 4*c* are being slidedly mounted, being embedded in jaws 1*a*, 1*b* and 1*c*. Connectors 4*a*, 4*b* and 4*c* ensure aligning the driver 3 relative to the axis of the device. While revolving, the connectors 4*a*, 4*b* and 4*c* move relative to the axis in the said elongated orifices. The profiled working surfaces 5*a*, 5*b*, 5*c* which are internally directed exert an influence on the material. Each jaw 1*a*, 1*b*, 1*c* moves along its guiding surface under the control of its guide 2*a*, 2*b*, 3*c* in such manner, that its lateral surface $6a_1$, $6b_2$, $6c_3$ moves on lateral surface $6b_1$, $6c_2$, $6a_3$ of adjoining jaw 1*b*, 1*c*, 1*a*. For each jaw 1*a*, 1*b*, 1*c* a border contact of its working surface 5*a*, 5*b*, 5*c* with lateral surface $6a_1$, or $6a_3$, $6b_1$ or $6b_2$, $6c_2$ or $6c_3$ respectively latter makes this surface a guiding, on and at the same time the generating lines of the lateral surfaces are of the cooperating jaws are parallel. As presented in FIG. 1, the initial working position of the device jaws 1*a*, 1*b*, 1*c* are displaced. In the resulting orifice plastic material is placed. A revolution of the driver 3 relative to a rigid system of guides 2*a*, 2*b* and 2*c* causes the jaws 1*a*, 1*b* and 1*c* to move to the inside. A small movement of the driver 3 is changed by means of connectors 4*a*, 4*b*, 4*c* to linear movement of each jaw 1*a*, 1*b* 1*c* along its guiding surface. Lateral surfaces $6a_1$, and $6a_3$, $6b_1$ and $6b_2$, $6c_2$ and $6c_3$ of jaws 1*a*, 1*b* 1*c* slide along each other, and at the same time lateral surfaces $6a_1$, and $6a_3$, $6b_1$, $6b_2$ and $6c_2$, $6c_3$ and $6a_3$ of two adjoining co-operating other jaws 1*a* and 1*b*, 1*b* and 1*c*, 1*c* and 1*a* are identical and having a shape corresponding to a dividing line along a workpiece, such line being a border of contact of the adjoining profiled working surfaces 5*a*, 5*b* and 5*c* of the jaws 1*a*, 1*b* and 1*c* at their final working position. In consequence of jaws 1*a*, 1*b* and 1*c*simultaneous movement their profiled working surfaces 5*a*, 5*b* 5*c* and lateral surfaces $6a_3$, $6b_1$, $6c_2$ form the plastic material. In the device's final working position, presented in FIG. 2, jaws 1*a*, 1*b*, 1*c* are pushed together. Treated plastic material obtains a form, determined by profiled working surfaces 5*a*, 5*b*, 5*c* of jaws 1*a*, 1*b*, 1*c*. The mating lateral surfaces 6*a*1, 6*b*1, etc. between the various jaws prevents the material being extruded by the jaws from escaping between the jaws. A retraction of the jaws 1*a*, 1*b* and 1*c* occurs when the driver 3 turns in the opposite direction.

The driver 3 is composed of the two flat elements covering the jaws 1*a* , 1*b* and 1*c*, while a system of guides 2*a*, 2*b* and 2*a* constitutes a housing of the device.

Figure 3:
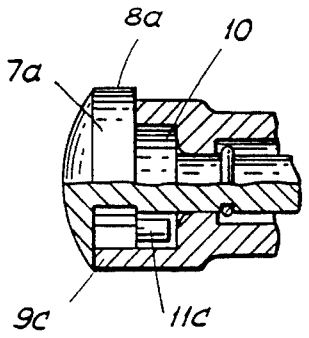
Figure 4:
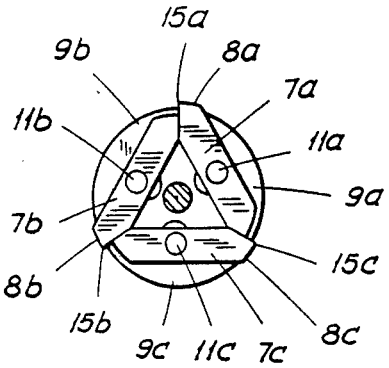
Figure 5A:
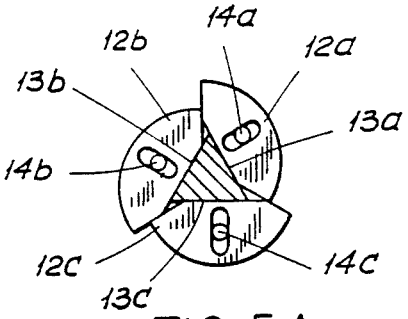
FIG. 5B is a cross-section of a portion of the device shown in FIG. 5A, FIG. 6 —the device with mould in cross-section.
Figure 5B:
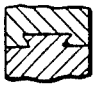

The device, presented in FIG. 3 and in FIG. 4 has jaws 7a, 7b,7c, working surfaces of which 8a, 8b, 8c are directed outside. Guides 9a, 9b, 9c, of jaws 7a, 7b, 7c are connected to each other and the device housing. Like drive 10 is an inner shaft, which through connectors 11a, 11b, 11c drives each jaw 7a, 7b, 7c. In FIGS. 5A and 5B an alternative of device from FIG. 3 and FIG. 4 is presented, in which jaws 12a, 12b, 12c are fixed on inner guides 13a, 13b, 13c and not illustrated driver (similar to the drive 3 shown in FIG. 1, but blocked from view in FIG. 5 by the jaws 1a, 1b and 1c is provided with connectors 14a, 14b and 14c embedded therein. A revolution of the guides 13a, 13b and 13c relative to the driver 3 and connectors 14a, 14b and 14c, makes the jaws 12a, 12b and 12c move. The lateral surfaces of the adjoining jaws 12a, 12b, and 12c move along each other and they move along the sides of the guides 13a, 13b and 13c via dovetail joints of the type illustrated to the right of FIG. 5

Figure 6:
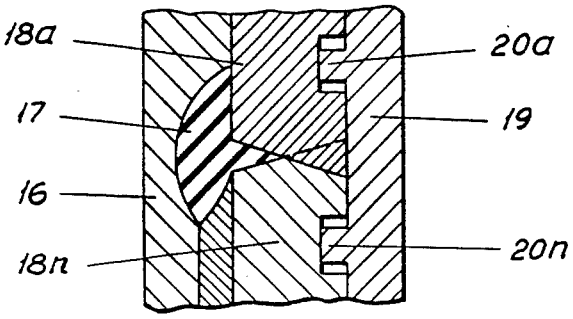

The working surfaces of the jaws 12a, 12b and 12c deform the material from the inside. It is preferable if the working surfaces of the said jaws, being externally directed, are provided with the cutting edges 15a, 15b and 15c. The device, as presented into the axial section in FIG. 6, is provided with a mould 16, being adjoined to the jaws 18a and 18n with their working surfaces directed to the inside. From the other side of the said jaws 18a, 18nit is provided with a driver 19 together with connectors 20a and 20n. The number of connectors 20a, 20n is the same as the number of jaws 18a, 18n. The jaws 18a, 18n are being placed into a rigid system of guides which are not illustrated. A portion of the material formed 17 is being fed between the jaws 18a and 18n. A revolution of the driver 19 relative to a system of guides makes the jaws 18a, 18n move to the inside in the same manner as in the device being presented in FIG. 1 and FIG. 2. Clamping of jaws 18a, 18n causes the extrusion of the material 17 into a forming mould 16. A workpiece assumes the shape of the mould 16 and of the working surfaces of jaws 18a, 18n. The solution as per this present invention enables manufacturing the details of complicated shapes and a direct extrusion of the material into a mould.

It ensures moreover cutting of the materials, clamping of the details on other elements and, if material powders or granules are initially used, it ensures obtaining shaped elements.

The device ensures a formation of bars, with cutting away the material or without cutting, in form od pyramids, balls, multi-keys or teeth and more complicatend forms, e.g. cruciform screwdrivers and semi-finished cutting tools. In case of plastic material and liguids, longitudinal forming jaws perform a role of profiling adjustable diaphragm. A use of heating elements in the device according to the invention renders permissible to operate the process of forming in higher temperatures than the ambient temperature of the material. The device according to the invention is characterized by great compactness and efficiency. It can be driven manually by means of a universal press or by its own uncomplicated drives.

I claim:

1. A multi-jaw forming press for forming objects the surface of which includes joined together sections, pairs of adjoining sections defining a line at the border therebetween, said press comprising:

movable jaws arranged around an axis of the press and lying in a common plane perpendicular to said axis, each of said jaws having a guiding surface and a profiled working surface opposite thereto shaped to define a surface section of the object being formed, each said working surface terminating in edges corresponding in shape to respective ones of the border lines of the section to be defined by the working surface, each of said jaws being movable in sliding contact with an adjacent jaw along a lateral surface of each said adjacent jaw, each said lateral surface adjoining one of the edges of the working surface of the jaw of which it is a part, and each said lateral surface being formed of parallel generating lines passing through its associated adjoining edge, a rigid system of guides, the guiding surface of each of said jaws being slidably engaged with said guides for movement there along in preselected directions, connectors embedded in said jaws, and a driver centered on said connectors driving said jaws through said connectors.

2. A mullti-jaw press as per claim 1 wherein said working surfaces of said jaws face generally inwardly towards said axis and define an axially extending space within said jaws, and a mould mounted on said jaws closing one end of said space, said jaws being effective when driven in a direction towards said axis for extruding an object within said space into said mould.

3. A multi-jaw press as per claim 1 wherein said working surfaces of said jaws face generally outwardly from said axis.

* * * * *